United States Patent [19]

Koenig

[11] 4,336,837

[45] Jun. 29, 1982

[54] ENTIRELY PASSIVE HEAT PIPE APPARATUS CAPABLE OF OPERATING AGAINST GRAVITY

[75] Inventor: Daniel R. Koenig, Santa Fe, N. Mex.

[73] Assignee: The United States of America as represented by the United States Department of Energy, Washington, D.C.

[21] Appl. No.: 233,365

[22] Filed: Feb. 11, 1981

[51] Int. Cl.[3] ..... F28D 15/00

[52] U.S. Cl. ..... 165/104.22; 126/433; 165/104.26

[58] Field of Search ..... 165/104.22, 104.26; 126/433

[56] References Cited

U.S. PATENT DOCUMENTS 4,252,185 2/1981 Kosson ..... 126/433 X

FOREIGN PATENT DOCUMENTS 643737 1/1979 U.S.S.R. ..... 165/104.26
664014 5/1979 U.S.S.R. ..... 165/104.22
676849 7/1979 U.S.S.R. ..... 165/104.22
691672 10/1979 U.S.S.R. ..... 165/104.22

*Primary Examiner*—Albert W. Davis
*Attorney, Agent, or Firm*—Robert W. Weig; Paul D. Gaetjens; Richard G. Besha

[57] ABSTRACT

The disclosure is directed to an entirely passive heat pipe apparatus capable of operating against gravity for vertical distances in the order of 3 to 7 meters and more. A return conduit into which an inert gas is introduced is used to lower the specific density of the working fluid so that it may be returned a greater vertical distance from condenser to evaporator.

13 Claims, 5 Drawing Figures

ENTIRELY PASSIVE HEAT PIPE APPARATUS CAPABLE OF OPERATING AGAINST GRAVITY

BACKGROUND OF THE INVENTION

The invention relates to heat pipes and more particularly to entirely passive heat pipes capable of operating against gravity. It is a result of a contract with the Department of Energy contract W-7405-ENG-36.

Conventional heat pipes usually are capable of operating in a horizontal position, gravity free environment such as outer space, or with gravity assistance. A heat pipe operates with gravity assistance where heat is transported from a source located at the bottom of the pipe, its lower end, to a heat sink situated atop the pipe, at a gravitationally higher position. In such a case liquid condensed at the top of the pipe returns to the bottom thereof with the assistance of gravity. To a rather limited extent conventional heat pipes can also do the reverse, that is, transfer heat from an elevated source to a lower sink and return the condensed liquid to the top of the pipe by capillary action. It will, however, be appreciated by those skilled in the art that in practical heat pipe designs, capillary action is limited by the height to which liquids can be raised thereby, typically less than a meter.

SUMMARY OF THE INVENTION

It is one object of the invention to provide a passive heat pipe with an extended pumping height for transferring heat from an elevated source to a lower sink.

It is another object of the invention to provide in a purely passive device pumping heights in the 3 to 7 meter (m) or greater range.

In accordance with the present invention there is provided a heat pipe apparatus capable of operating against gravity comprising a heat pipe envelope containing an evaporator and a condenser, the evaporator being disposed gravitationally above the condenser. A gas and a working fluid are disposed within the envelope, the fluid comprising a liquid and its vapor. A venturi is disposed between the evaporator and the condenser and a reservoir is located in the vicinity of the venturi. The reservoir contains the fluid in its liquid phase and the gas. A conduit, such as a tube, provides a path for the liquid and the gas between the condenser and the reservoir. The conduit may be disposed entirely within the heat pipe envelope or a substantial portion of it can be external of the envelope if so desired. A capillary wick is provided between the reservoir and the evaporator for carrying the liquid in the reservoir to the evaporator. An ejector is disposed at the venturi for introducing gas from the reservoir into the venturi. The heat pipe can move heat in a 3 to 10 m range and is entirely passive.

One advantage of the instant invention is that it has wide application in space and water heating using solar energy where typically heat is transferred from roof top solar collectors to in-ground or basement level thermal storage.

Another advantage of the instant invention is that heat transfer in accordance therewith is entirely passive, there being no need for an external pump.

Another advantage of the invention is that because no external pump is required, no additional sources of energy are needed to operate the heat pipe of the invention.

Additional objects, advantages, and novel features of the invention will be set forth in part in the description which follows, and will become apparent to those skilled in the art upon examination of the following, or may be learned by practice of the invention. The objects and advantages of the invention may be realized and obtained by means of the instrumentalities and combinations particularly pointed out in the appended claims.

DETAILED DESCRIPTION OF THE INVENTION

Figure 1:
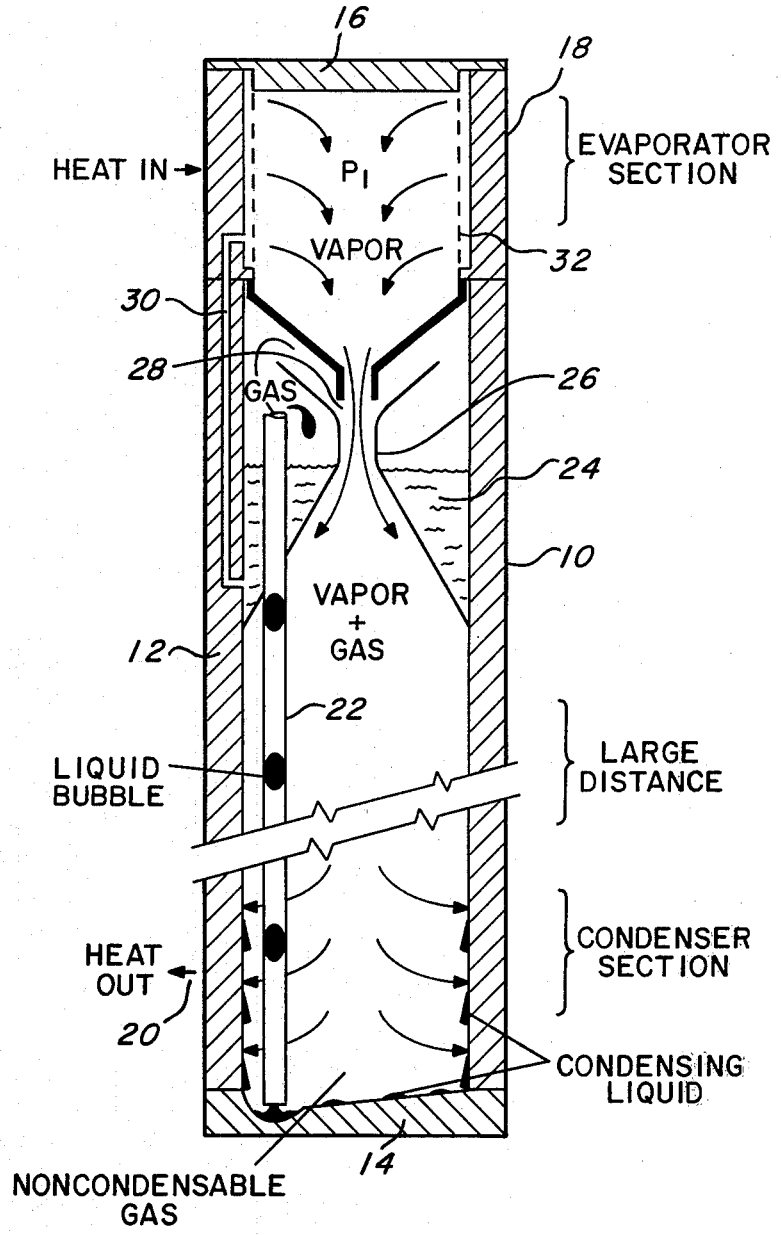
FIG. 1 shows a cross-sectional view of a preferred embodiment of the invention.
Figure 2:
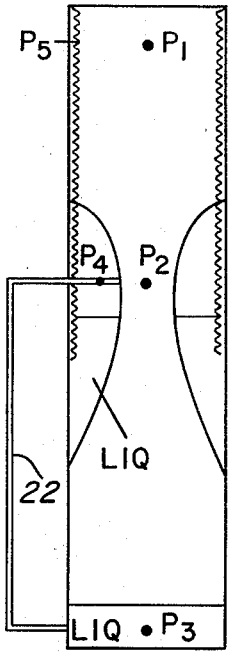
FIG. 2 schematically shows the invention.

Reference is now made to FIG. 1 which illustrates a preferred embodiment of the invention. Because heat pipes in accordance with the invention in typical applications will be quite long, on the order of 3 to 10 meters, and are only perhaps 2 to 10 centimeters (cm) in diameter, the illustration in FIG. 1 shows a severed heat pipe in order to clearly show all necessary aspects of the device in one figure. As seen in FIG. 1, a heat pipe envelope 10 comprising walls 12 and end plates 14 and 16 provides a sealed environment for a fluid comprising a liquid and its vapor. This fluid may comprise, for example, water and water vapor, freon, ammonia, or methanol. Also provided within the envelope is a gas or combination of gases such as air, nitrogen, neon, argon, or helium which does not chemically react with the fluid. The gas is, in effect, inert. The purposes of this gas will become apparent hereinafter. Heat pipe envelope 10 comprises an evaporator section or area 18 and a condenser section or area 20. As is usual in heat pipes, during operation the fluid will be in its liquid phase in the condenser section and in its vapor phase in the evaporator section. A conduit 22 is provided for liquid and gas transport from the condenser section 20 into a reservoir section 24 which contains the fluid in its liquid phase as well as gas returned through the conduit. The reservoir is disposed in the vicinity of a venturi 26 through which vapor from the evaporator section must pass. Gas from the reservoir section enters the venturi area through an ejector 28. Liquid from the reservoir 24 is carried to evaporator section 18 through a capillary wick 30 or other commonly known capillary action liquid transporting means used in heat pipes. Portion 32 of wick 30 lines the walls of the evaporator section to provide a source of vapor. Initially the gas is evenly distributed throughout the heat pipe envelope and heat is applied to the evaporator section. The heat produces vapor from the wick portion 32. This creates a pressure $P_1$ in the evaporator section of the heat pipe as noted in FIG. 3. FIG. 2 schematically shows the heat pipe of the invention of FIG. 1, illustrating pressures present in the FIG. 1 embodiment. As the gas and vapor pass through venturi 26, pressure therein decreases. As the flow of the vapor and gas reaches an equilibrium or steady state in the venturi, the pressure therein reaches $P_2$, $P_2$ being always less than $P_1$. As the vapor and gas enter the condenser section 20 of the heat pipe envelope 10, the vapor condenses on the walls of the condenser section and a liquid pool forms at the very bottom of the heat pipe on end plate 14. This liquid is at a pressure of $P_3$, $P_3$ being greater than $P_2$. The pressure difference, $P_3-P_2$, forces liquid which has condensed from the vapor as well as the gas which accumulates just above the pool into the conduit 22. In practice, liquid bubbles occur spaced between volumetrically larger amounts of gas such that the average density of the returning gas-liquid mixture is about 1-10% of the density of the condensed liquid. The pressure differential pushes the gas and liquid through conduit 22 up into the reservoir 24. Movement of gas and liquid up large heights is possible because the average density of the gas and liquid is much less than that for the liquid alone. As can be seen in FIG. 2, the conduit need not be entirely internal of the heat pipe envelope but may be an external element as shown in FIG. 2 as conduit 22'. The returning liquid pours over the lip of the conduit and accumulates in the reservoir. The liquid is transported therefrom through a conventional heat pipe wick 30 such as a screen or other type of capillary device up to wick 32 in the evaporator section of the heat pipe. The gas arriving in the reservoir has a pressure $P_4$ which is greater than $P_2$ but less than $P_3$. The gas is reintroduced into the system through ejector 28 into the venturi. At this point a continuous process has been reached. Liquid returned to the reservoir and passed from there to the evaporator section turns into vapor. Returning gas has been reintroduced into the venturi. Once the heat pipe is operating, essentially no gas remains in the evaporator section although some residual gas there would not make any difference to the operation of the device.

The primary purpose of the gas is to greatly reduce the specific density of the liquid returning from the condenser section to the evaporator section over a length of several meters. Capillary action of a wick can not return liquid the vertical distances reached in practicing the invention. Because a small fraction of the kinetic energy of the vapor is used to cause the uncondensable gas to flow up the liquid return tube, the uncondensable gas lowers the average density of the returning gas liquid mixture considerably below that of a fully liquid column.

An apparatus in accordance with the invention can operate over fairly large vertical distances. Thus for a given pressure difference available for pumping, the invention provides a circulating fluid to be pumped back capable of reaching much greater heights than would be possible with a fully liquid return path through a capillary. The typical wicking height for a conventional water heat pipe is 0.4 m. If the average density in the return tube or conduit is reduced by a factor of 10 in accordance with the invention, the returning gas-water fluid could flow up to a height of 4 m.

Figure 3:
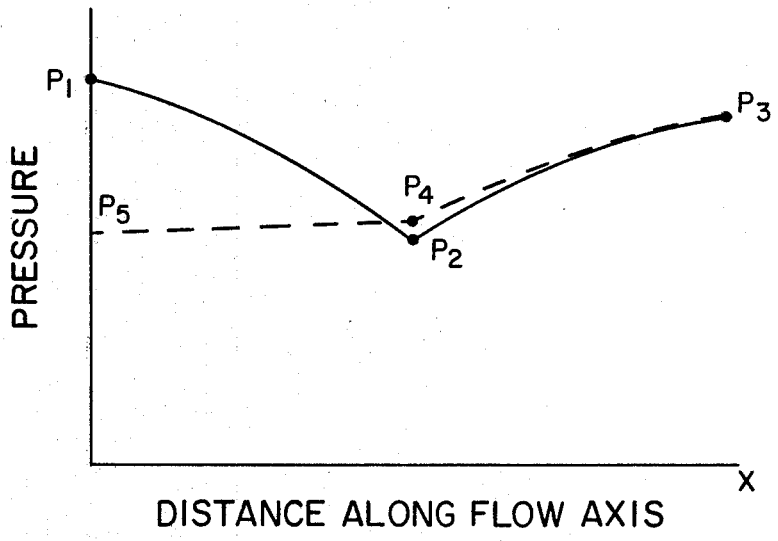
FIG. 3 graphically illustrates a pressure profile in the heat pipes of FIGS. 1 and 2.

As seen in FIG. 3, the pressure difference $P_1-P_2$ is developed by the acceleration of the vapor as it flows out of the evaporator into the throat of the venturi ejector. As the vapor and inert gas come to rest at the bottom of the condenser, their pressure rises from $P_2$ to $P_3$. The liquid and inert gas flow up the return tube arriving at the reservoir pressure at $P_4$. The pressure difference $P_3-P_4$ is the pressure head available for pumping the fluid up the return tube. The difference $P_1-P_5$ is what must be provided by the capillary force in the evaporator wick to pull the liquid from the reservoir to the surface of the evaporator.

Those skilled in the art will appreciate that for proper operation of a heat pipe in accordance with the invention the following conditions must be met. $P_4>P_2$, $P_1>P_3$ and $P_3>P_2$. For two-phase flow in vertical tubes calculations can be made utilizing equations shown in *One Dimensional Two Phase Flow* by G. B. Wallis, McGraw Hill, Inc., 1969. Appropriate pressures can be calculated using well-known established theory for venturi ejector performance such as given in *Fundamentals of Gas Dynamics,* by L. Crocco, Vol. III, edited by H. W. Emmons, Princeton University Press, 1958. Calculations show that a water vapor heat pipe utilizing air as the inert gas should be able to operate against gravity at heights up to several meters, such as about 7 m.

Figure 4:
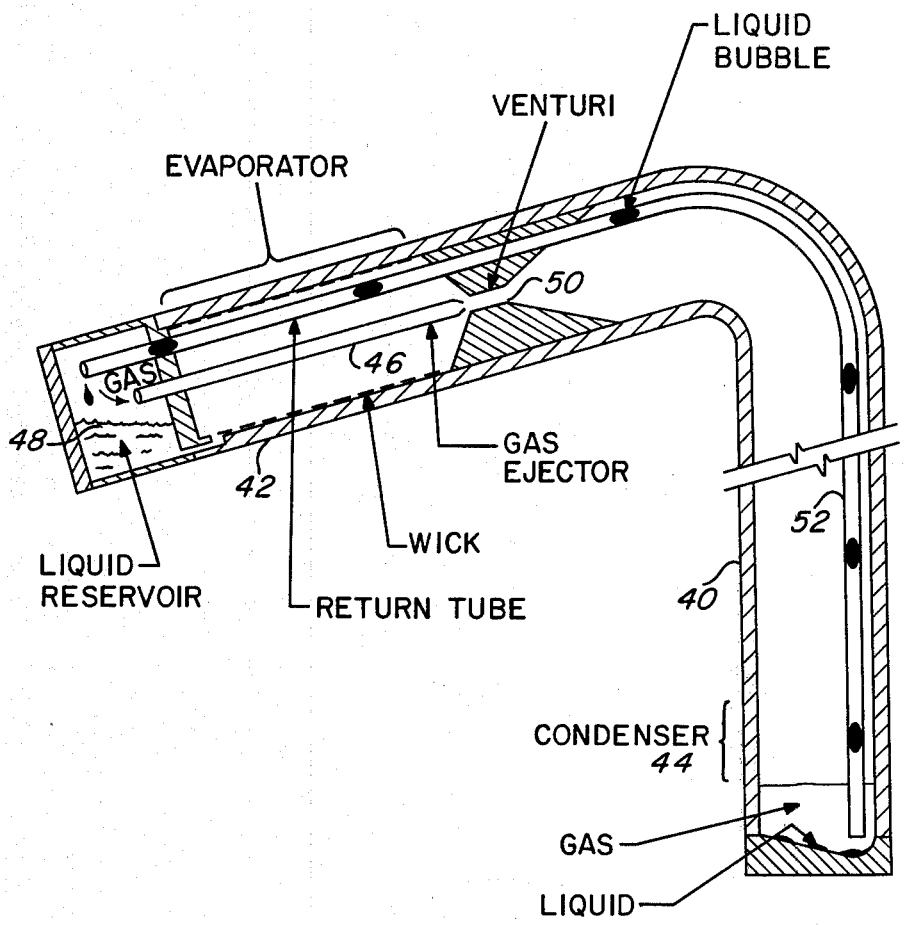
FIG. 4 illustrates another embodiment of the invention.

Another embodiment of a heat pipe in accordance with the invention is shown in FIG. 4. Therein, a heat pipe envelope 40 which is particularly adapted for use in solar energy applications comprises an evaporator section 42 which could advantageously utilize the incline of an inclined roof. It could alternatively comprise an evaporator section in a horizontal position employable on a flat foor. Collected energy moves from the evaporator section to a condenser section 44 which could be located in a basement or at ground level. The configuration of its ejector 46 is different than in the embodiment of FIG. 1. Too, its reservoir 48 is located in a different position. A venturi 50 is provided as is a return conduit 52. However, its operation is the same as that of the device of FIG. 1. Envelope 40 is a lengthy device and a break is shown, this embodiment being about 7 or 8 m high.

Figure 5:
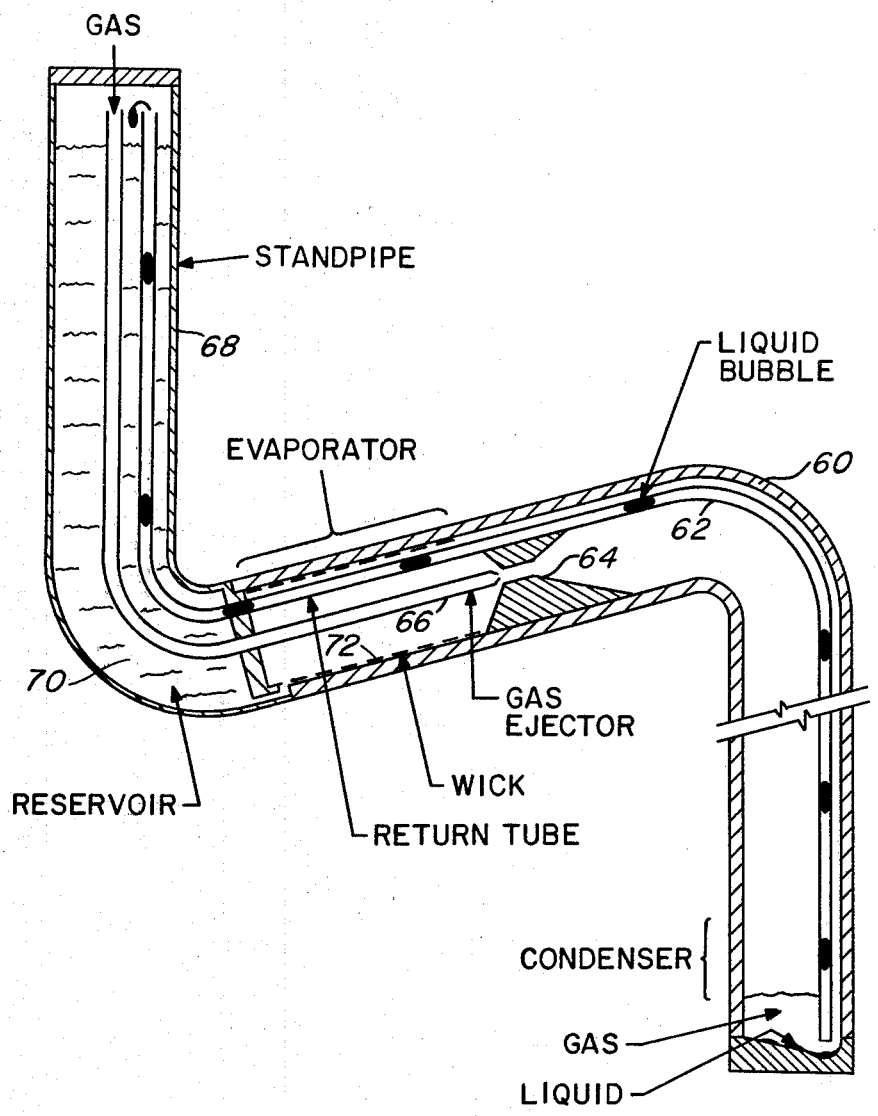
FIG. 5 depicts yet another embodiment of the invention.

FIG. 5 illustrates another embodiment of the invention having a heat pipe envelope 60, a return conduit 62, a venturi 64, a reservoir 70 and an evaporator wick 72. An ejector 66 is essentially the same configuration as ejector 64 of FIG. 4. The difference between the FIG. 5 embodiment and that of FIG. 4 is that a vertical liquid reservoir including a stand pipe 68 is provided in order to raise the pressure on the liquid at the bottom of reservoir 70 utilizing the height of the liquid column above it. This reduces the pressure difference across evaporator wick 72 and thereby reduces the capillary force requirement of the wick's design. A small penalty is paid for this configuration in that the liquid in the return tube has to be raised the additional height of the stand pipe.

The foregoing description of several embodiments of the invention has been presented for purposes of illustration and description and is not intended to be exhaustive or to limit the invention to the precise forms disclosed. They were chosen and described in order to best explain the principles of the invention and their practical application to thereby enable others skilled in the art to best utilize the invention in various embodiments and with various modifications as are suited to the particular use contemplated. It is intended that the scope of the invention be defined by the claims appended hereto.

What is claimed is:

1. A heat pipe apparatus capable of operating against gravity comprising:

a heat pipe envelope comprising evaporator means and condenser means, said evaporator means being disposed gravitationally above said condenser means;

a gas and a working fluid within said heat pipe envelope, said fluid comprising a liquid and its vapor, said fluid comprising its liquid phase while in the condenser means and its vapor phase while in the evaporator means;

venturi means disposed between said evaporator means and said condenser means;

reservoir means disposed in the vicinity of said venturi means for containing said fluid in its liquid phase and said gas;

conduit means providing a path for said liquid and said gas between said condenser means and said reservoir means;

capillary wick means providing a path for liquid within said reservoir means to said evaporator means; and means for introducing gas from said reservoir means into said venturi means.

2. The invention of claim 1 wherein said conduit means comprises a tube.

3. The invention of claim 1 wherein said conduit means is disposed entirely within said heat pipe envelope.

4. The invention of claim 1 wherein said conduit means is disposed substantially external of said heat pipe envelope.

5. The invention of claim 1 wherein said evaporator means is disposed between about three and about ten meters above said condenser means.

6. The invention of claim 1 wherein the mixture of the liquid and gas within said conduit means comprises from about 1% to about 10% gas by weight.

7. The invention of claim 1 wherein said heat pipe envelope is between about 3 meters and 7 meters in length.

8. The invention of claim 6 wherein said working fluid comprises water and water vapor.

9. The invention of claim 7 wherein said gas comprises air.

10. The invention of claim 1 wherein said working fluid is selected from the group consisting of freon, ammonia, methanol.

11. The invention of claim 9 wherein said gas is selected from the group consisting of nitrogen, argon, and helium.

12. The invention of claim 1 wherein said heat pipe envelope comprises about a 90° or greater bend.

13. The invention of claim 1 wherein said heat pipe envelope comprises at least two bends of 90° or more and a standpipe section above said reservoir.

* * * * *